United States Patent [19]

Takahashi et al.

[11] 4,144,016

[45] Mar. 13, 1979

[54] BURNER

[75] Inventors: Yasuro Takahashi; Hisao Yamamoto; Masayasu Sakai; Toshiyuki Takegawa, Nagasaki, all of Japan

[73] Assignee: Mitsubishi Jukogyo Kabushiki Kaisha, Japan

[21] Appl. No.: 767,144

[22] Filed: Feb. 9, 1977

[30] Foreign Application Priority Data

Feb. 10, 1976 [JP] Japan ..... 51-12841

[51] Int. Cl.[2] ..... F23C 5/00

[52] U.S. Cl. ..... 431/8; 431/175; 431/188; 431/190

[58] Field of Search ..... 431/190, 188, 175, 8

[56] References Cited

U.S. PATENT DOCUMENTS 2,140,088 12/1938 MacDonald ..... 431/190 X 3,463,602 8/1969 Bitterlich et al. ..... 431/188

3,957,420 5/1976 Asai et al. ..... 431/190

*Primary Examiner*—Edward G. Favors

*Attorney, Agent, or Firm*—McGlew and Tuttle

[57] ABSTRACT

A burner includes a plurality of air nozzles open toward a furnace and which are disposed unsymmetrically with respect to the central axis of the burner and so combined that the velocity of combustion air to issue from one or more of the nozzles is higher than the mean air velocity through the total air nozzle opening area and the velocity of combustion air from the rest of the nozzles is lower than the mean velocity. The opening area of the lower-velocity air nozzle or nozzles accounts for from 30 to 60% of the total opening area. A fuel nozzle or nozzles are located within or adjacent the lower-velocity air nozzle or nozzles. The amount of air to issue from the lower-velocity air nozzle or nozzles is not more than 70% of the theoretical air for the fuel to jet out of the burner.

5 Claims, 14 Drawing Figures

BURNER

FIELD AND BACKGROUND OF THE INVENTION

This invention relates to a fuel-firing burner which gives off combustion exhaust gases with reduced nitrogen oxide contents.

Nitrogen oxides (hereinafter called "NOx") in a combustion flame are mostly formed as the oxygen and nitrogen molecules in the air combine as a result of the combustion. The production of NOx depends largely on the flame temperature, the higher the temperature the faster the tempo in which NOx are formed. It is well-recognized, therefore, that lowering the flame temperature is effective in decreasing the NOx production that accompanies the process of combustion.

With ordinary fuel-firing burners, attempts have been made to reduce the NOx contents of their combustion exhaust gases, for example, by (a) a stepwise combustion method, so called because part of the combustion air is supplied from the burner itself to lower the excess air ratio in the burner and the rest of the excess air is issued from ports independent of the burner, or (b) an inert gas addition method whereby an inert gas (e.g., the combustion exhaust gas) is mixed in the combustion air.

Of those prior art methods, the former that requires additional ports outside of the burner has disadvantages of high initial investment in equipment and inconvenience in controlling the air supply. For the latter, extra ducting and installation of a fan and other mixing facilities are inevitable.

In an effort to mitigate those drawbacks, a burner as typically illustrated in FIG. 1 has been devised to supply air for stepwise combustion from around the outlet of the burner so that the aforesaid beneficial effect is attained at relatively low equipment cost.

In the arrangement of FIG. 1, most of the combustion air issues from the burner nozzle 1 and mixes and burns with most of the fuel. The balance of the air for stepwise combustion is admitted from ports 2 to mix and burn with the balance of the fuel in the afterstream portion of the flame. If the ports 2 are located close to the burner nozzle 1, the air for stepwise combustion will join the flame rather prematurely and abate the NOx-controlling effect. Therefore, the ports must be kept away from the burner nozzle 1, thus increasing the overall burner dimensions.

SUMMARY OF THE INVENTION

With the view to eliminating the foregoing disadvantages, the present invention is directed to the provision of a burner of a low-cost construction which achieves substantially the same favorable effect as by the prior art stepwise combustion method, with a burner size practically as compact as those of conventional burners not designed for the stepwise combustion.

More particularly, the invention is concerned with a burner of a type which diffuses and mixes fuel and air in the afterstream portion of the flame within the burner, and of a construction capable of decreasing the concentration of NOx to be formed in the combustion exhaust. The construction is characterized in that:

(1) The burner comprises two or more air nozzles.

(2) The air nozzles are arranged unsymmetrically with respect of the central axis of the burner at its outlet.

(3) The velocity of combustion air to issue from the air nozzles is a combination of velocities from different nozzle groups which velocities are respectively higher and lower than the mean velocity through the overall outlet opening area of the burner.

(4) The lower-velocity air nozzle group is designed to have an outlet opening area accounting for from 30 to 60% of the total outlet opening area of the burner.

(5) At least one fuel nozzle is located within or adjacent the lower-velocity air nozzle.

(6) The amount of air that issues from the lower-velocity air nozzle group is not more than 70% of the theoretical amount of air required for the combustion of the fuel injected.

(7) The combined air-fuel ratio for the two groups is such that the excess fuel ratio is not less than 1.

BRIEF DESCRIPTION OF THE DRAWINGS

These and other objects, features, and advantages of the invention will become more apparent from the following description taken in conjunction with the accompanying drawings, wherein.

DESCRIPTION OF THE PREFERRED EMBODIMENTS

Figure 1:
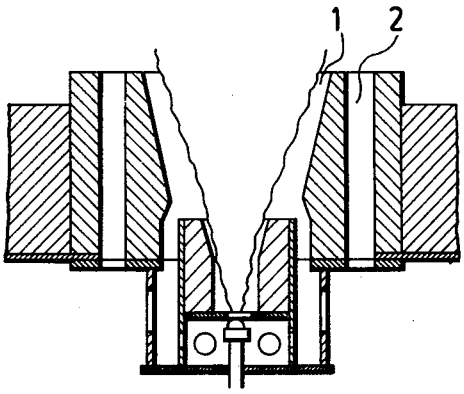
FIG. 1 is a sectional view of an ordinary stepwise combustion mechanism in which ports for supplying jets of stepwise combustion air are disposed around a burner body.
Figure 2:
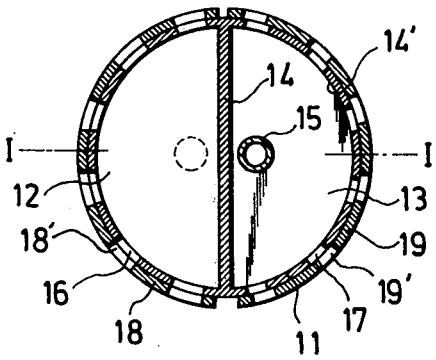
FIG. 2 is a transverse sectional view of a burner embodying the invention, taken along the line II—II of FIG. 4.
Figure 3:
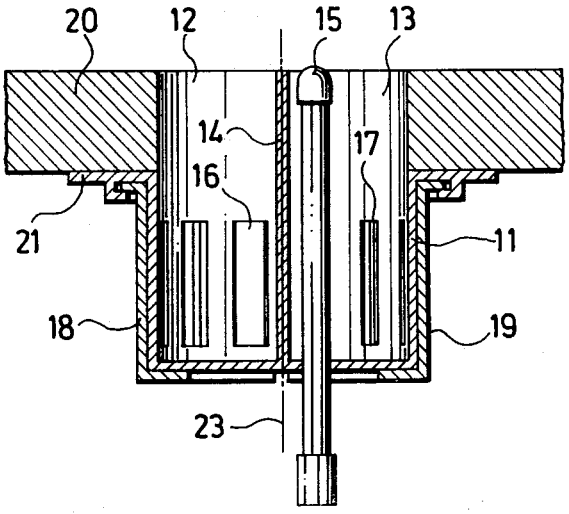
FIG. 3 is a longitudinal sectional view taken along the line I—I of FIG. 2.
Figure 4:
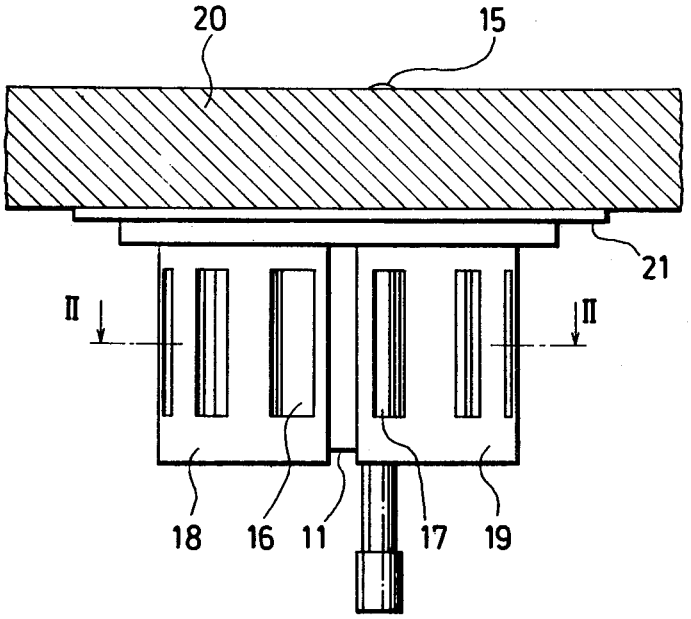
FIG. 4 is a side view of the same embodiment.

Referring to FIGS. 2 to 4, there is shown a burner embodying the invention, generally indicated at 11, as comprising two air nozzles 12, 13.

The nozzle 12 is set so that air issuing therefrom is at a velocity higher than the mean velocity of air as measured through the total cross sectional area of the outlet openings of the burner, and the nozzle 13 is set so that the velocity of the air jet it delivers is lower than the mean velocity through the same outlet opening area. These two air nozzles 12, 13 are bordered by a partition wall 14, which combines with a cylindrical wall 14' to define the two nozzles.

The two air nozzles 12, 13 are disposed unsymmetrically with respect to the central axis 23 of the burner. The air nozzle 13 is designed so that the cross sectional area of its outlet opening accounts for a percentage between 30% and 60% of the combined opening area of the nozzles 12, 13.

A fuel nozzle 15 is located in the lower-velocity air nozzle 13. An additional fuel nozzle 15 may be installed, if desired, in the other air nozzle 12 which involves the higher air velocity. In the latter case, the additional nozzle must be located close to the lower-velocity air nozzle 13, for example, as indicated by a broken-line circle. Air inlet ports 16, 17 are formed in the cylindrical wall 14' to admit combustion air into the burner. The total area of the air inlet ports 17 for the air nozzle 13 is made smaller than that of the air inlet ports 16 for the air nozzle 12 to lower the velocity of the air jet from the nozzle 13. In order to vary the areas of the two groups of air inlet ports, a pair of semicylindrical registers 18, 19 are held slidably around the cylindrical wall 14'. The registers 18, 19 have pluralities of damper ports 18', 19', respectively, adapted to be superposed with the ports 16, 17.

The burner 11 is secured to a furnace wall 20 by a flange 21 and is open into the furnace.

In the burner of the construction above described, there occurs non-uniformity in the air distribution in the plane perpendicular to the central axis 23 of the burner at its outlet. As a result, at the burner outlet portion representing the air nozzle from which the jet of air comes out at a lower velocity, the fuel burns after delayed mixing with the air required for complete combustion. The resultant combustion gas is mixed with the combustion gas formed by the air nozzle 12 that produces the higher-velocity air jet, whereby combustion air with a reduced partial pressure of oxygen is supplied. This permits the beneficial effects of the stepwise combustion and inert gas addition methods to be combinedly achieved, with a consequent marked reduction in the NOx production in the exhaust gases.

The appropriate ranges of the air nozzle area, flow rate distribution, and partial excess air ratio herein specified under the present invention are based on the results of numerous combustion tests.

Figure 5:
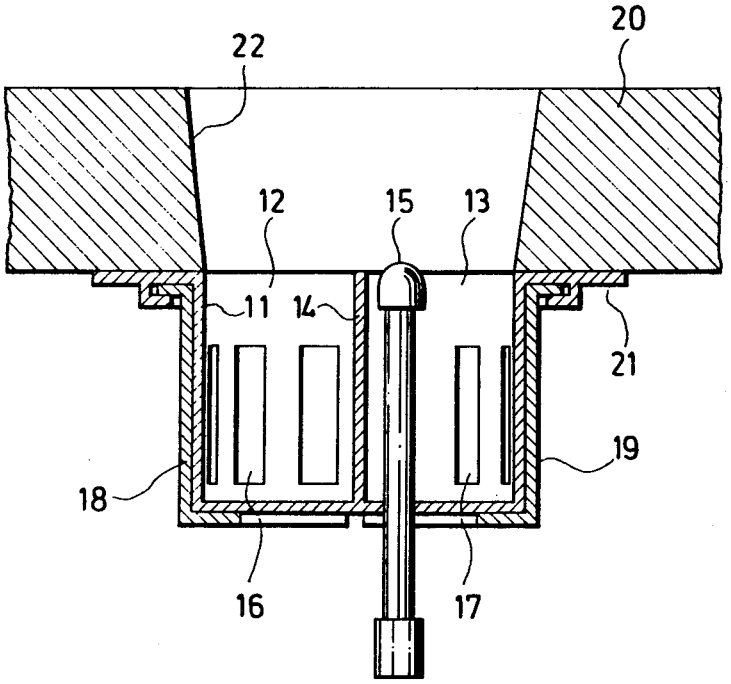
FIG. 5 is a sectional view of a modification having an extension nozzle of refractory material or the like at the burner outlet.

It has been experimentally confirmed that, aside from the embodiment just described, the burner according to the invention may be equipped, as in FIG. 5, with an extension nozzle 22 of refractory material or the like without practically impairing its functions.

Also, the burner configurations are not limited to the circular ones as shown in FIGS. 2 through 5. The burner may take a square shape if it still meets the essential requirements as such in accordance with the invention. It is also possible to place the burner in a windbox and use it as a burner of the forced draft type. These modifications will readily occur to those skilled in handling such combustion equipment. Further, a plurality of fuel nozzles may be employed instead of one without departing from the scope of the invention.

Figure 6:
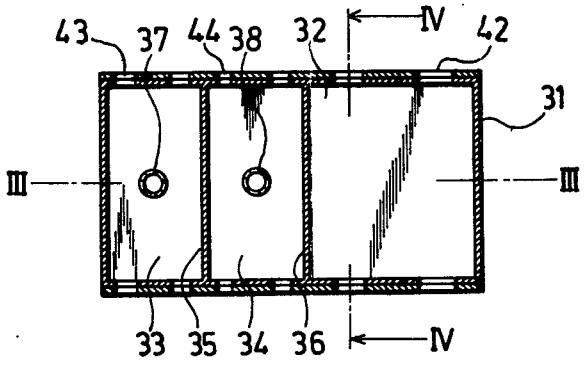
FIG. 6 is a plan view of the outlet of another embodiment of the burner according to the invention.
Figure 7:
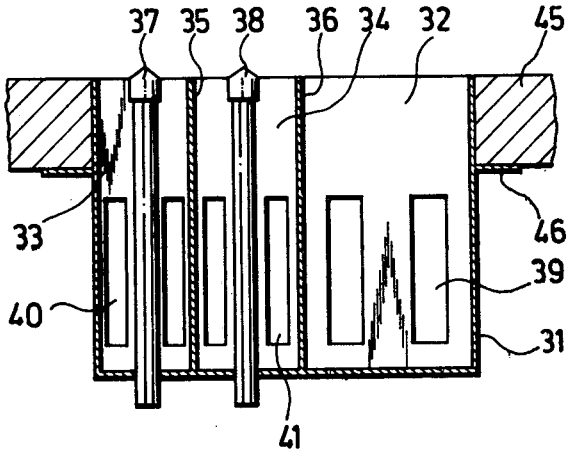
FIG. 7 is a sectional view taken along the line III—III of FIG. 6.
Figure 8:
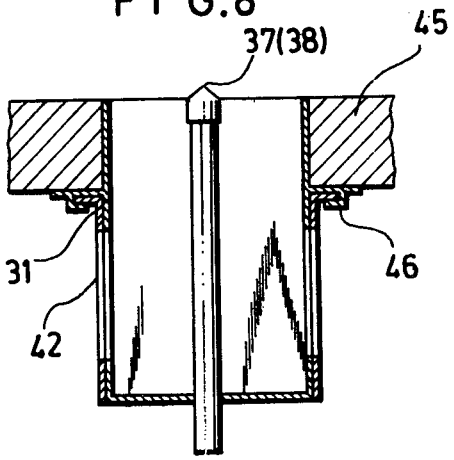
FIG. 8 is a sectional view taken along the line IV—IV of FIG. 6.

By way of exemplification, another embodiment is illustrated in FIGS. 6 to 8, in which the burner is square-shaped, has two lower-velocity air nozzles, and uses two fuel nozzles.

In those figures, the burner is generally indicated at 31 as comprising three air nozzles 32, 33, 34 bordered by partition walls 35, 36. In this embodiment the air nozzle 32 gives a jet of air faster than the mean air velocity through the total burner outlet opening area, whereas the air nozzles 33, 34 give jets of a lower velocity than the mean value. The air nozzles 32, 33, 34 are arranged unsymmetrically with respect to the central axis of the burner, so that the sum of the outlet opening areas of the lower-velocity air nozzles 33, 34 is between 30% and 60% of the total opening area of all the air nozzles. Two fuel injection guns or nozzles 37, 38 are installed, one for each, in the lower-velocity air nozzles 33, 34.

Combustion air is admitted through air inlet ports 39, 40, 41 shown in FIG. 7. The inlet ports 40, 41 are smaller in area than the ports 39 to make the velocity of air jets from the nozzles 33, 34 lower than that from the nozzle 32. These air inlet ports 39, 40, 41 are equipped with registers 42, 43, 44 to damp and regulate the air supply in the same manner as with the embodiment previously described. Also, in the same way, the burner is attached to the furnace wall 45 by a flange 46.

As in the first embodiment, the air nozzle areas, air flow rate distribution, and partial excess air ratio of this second embodiment must be within appropriate ranges herein specified. In this embodiment the use of two lower-velocity air nozzles facilitates the adjustments of the burner within the specified ranges. In addition, the two fuel nozzles make multi-fuel firing readily possible. (For example, the nozzle 37 may be used to inject a gaseous fuel and the nozzle 38 a liquid fuel.)

As described above, the present invention provides a burner generally comparable in size to ordinary burners but which can readily exhibit a NOx-controlling effect by a combination of the stepwise combustion and inert gas addition techniques. According to the results of tests we conducted, the NOx production during combustion was as little as about 40 ppm in the exhaust when gas, kerosene, or light oil was used as the fuel. Even when grade 3(C) fuel oil was fired, the NOx production was not more than 100 ppm. Thus, a burner inexpensive in construction and yet highly effective in abating air pollution is obtained.

The appropriate ranges of air nozzle area proportions, flow rate proportions, and partial excess air ratio in accordance with the invention have been chosen as already stated, on the basis of a series of combustion tests performed. The results of exemplary tests are summarized in FIGS. 9 and 10.

In those figures, there are plotted the amounts of NOx, carbon monoxide (CO), and dust produced upon combustion of an airfuel mixture by a circular burner of substantially the same construction as the embodiment illustrated in FIGS. 2 to 5 (with the fuel nozzle located in the lower-velocity air nozzle) in test runs under the following conditions (with variations in the air nozzle area opening ratio).

Figure 9:
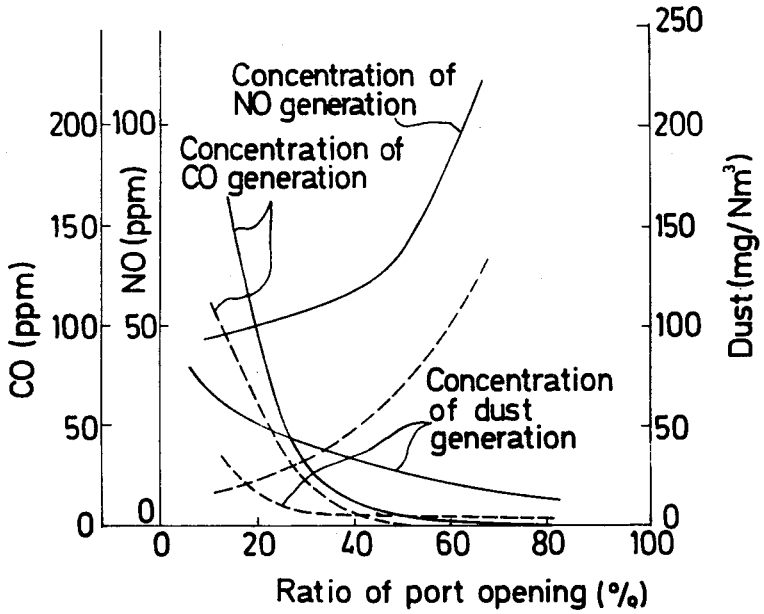
FIG. 9 is a graph showing the production of NO, CO, and dust in the combustion exhaust when the port opening ratio is varied and the amount of air from the lower-velocity air nozzle is set to not more than 70% of the theoretical air for combustion.

Test conditions (1) Heat release on combustion = approx. 400 × $10^4$ Kcal/Hr
(2) Natural draft type (air at ordinary temp., draft −15 mm Hg
(3) Combustion air ratio = 1.25
(4) Quantity of air issuing from the lower-velocity air nozzle = not more than 70% of the theoretical air for the burner As can be seen from FIG. 9, the concentration of dust formed undergoes little change but the concentration of NOx produced increases sharply as the ratio of the cross sectional area of the lower-velocity air nozzle to the total cross sectional area of the air nozzles (hereinafter called the "port opening ratio") exceeds 60%. The curve does not indicate any low-NOx characteristic. Where the port opening ratio is less than 30%, CO is actively formed and the combustion efficiency declines.

The results graphically represented in FIG. 9 were obtained when the amount of air issuing from the lower-velocity air nozzle was set to not more than 70% of the theoretical air for the burner. With a burner whose port opening ratio was not more than 60%, by contrast, the amount of air could be changed by varying the draft or draft resistance (i.e., by varying the air-inlet damper opening). The NO production relative to the changes in air quantity is plotted in FIG. 10. The firing conditions used were the same, except for the draft in the furnace, as those for the tests summarized in FIG. 9. The test results represented in FIG. 10 indicate that the NO production increases conspicuously as the amount of air issuing from the lower-velocity air nozzle accounts for more than 70% of the theoretical amount of air required for the combustion in the burner. Conversely if the amount of air decreases, the NO production will gradually decrease, too. If the proportion is less than 30%, however, the combustion will become unstable. (Where the combustion is to be effected deliberately under the last-mentioned condition for a low NO production, a suitable flame holder may be used to stabilize the combustion.)

Figure 10:
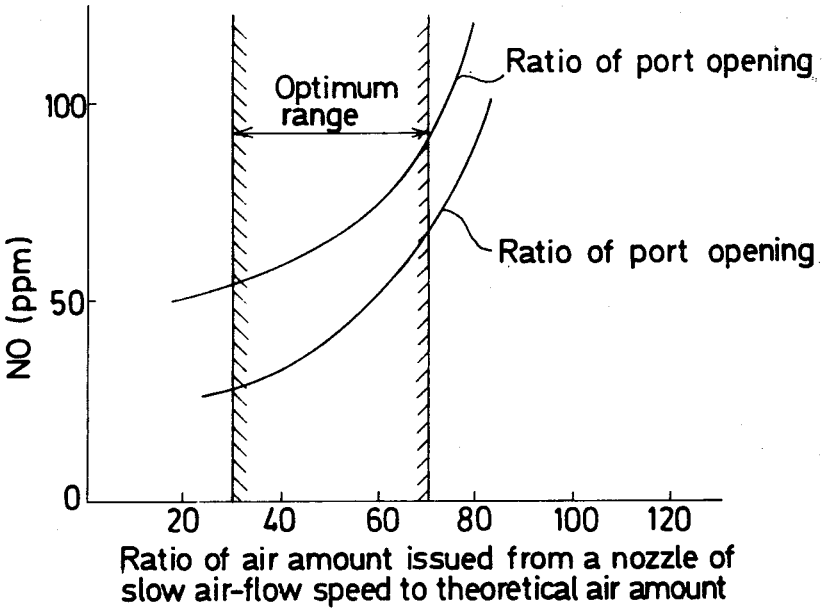
FIG. 10 is a graph showing the relationship of the NO production with changes in the amount of air.

In the exemplary tests the results of which are given in FIGS. 9 and 10, the velocities of air jets from the respective air nozzles were approximately 3 to 6 meters and 7 to 12 meters per second, where the amount of air from the lower-velocity nozzle was within the range from 30 to 70% of the theoretical air for the combustion. While the results of FIGS. 9 and 10 were primarily obtained from the combustion of grade C fuel oil, generally the same applies to various other fuels. By way of example, test results with a gaseous fuel (propane) are represented by broken-line curves in FIG. 9.

Results generally similar to those described above were obtained by tests with square-shaped burners.

The exemplary tests according to the invention have so far been described as performed with grade C fuel oil which is known to produce NOx in particularly high concentrations. As will be appreciated from the foregoing description, the overall NOx concentration formed by the combustion of grade C fuel oil under the conditions set forth in the claims is between 80 and 100 ppm. This fully meets the environmental requirements of the day. Of course, the same is true of other liquid and gaseous fuels.

Next, the results of tests conducted by way of example departing from the scope of this invention as defined in the claims, will now be discussed.

Figure 11A:
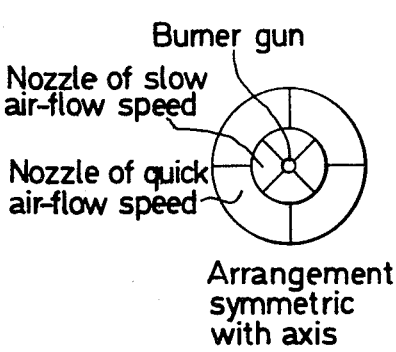
FIG. 11*a* is a schematic view of a burner in which air nozzles are arranged symmetrically with respect to the central axis of the burner.
Figure 11B:
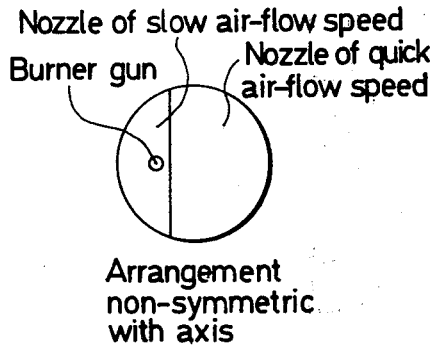
FIG. 11*b* is a schematic view of a burner according to the invention in which air nozzles are arranged nonsymmetrically with respect to the burner axis.
Figure 12:
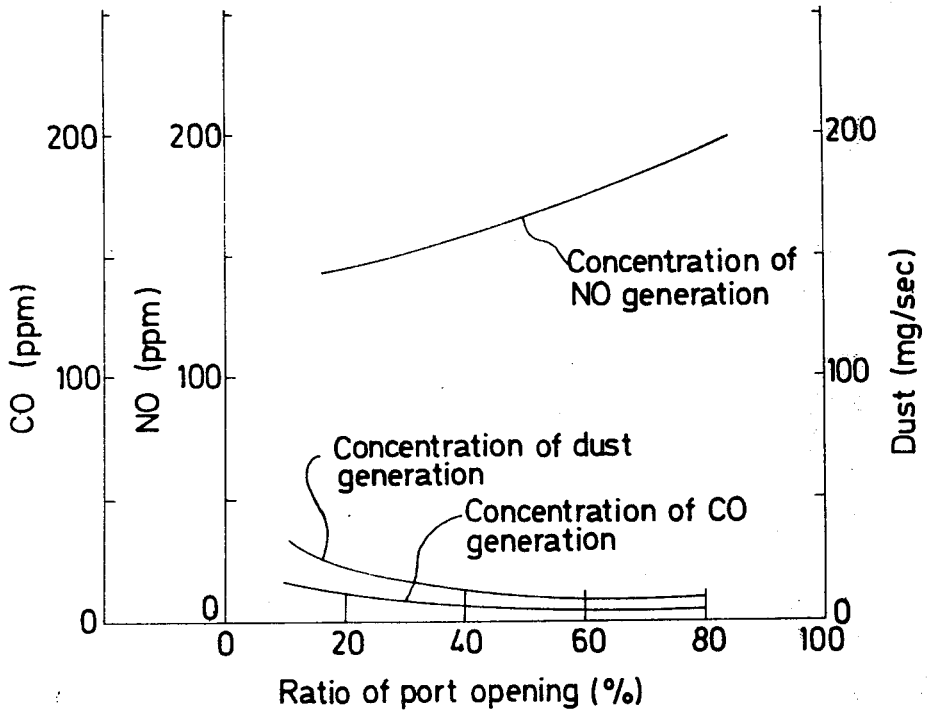
FIGS. 12 and 13 are graphs showing data of tests conducted with burners whose air nozzles were arranged symmetrically with respect to the burner axis, with port opening ratios ranging from 30 to 60%.
Figure 13:
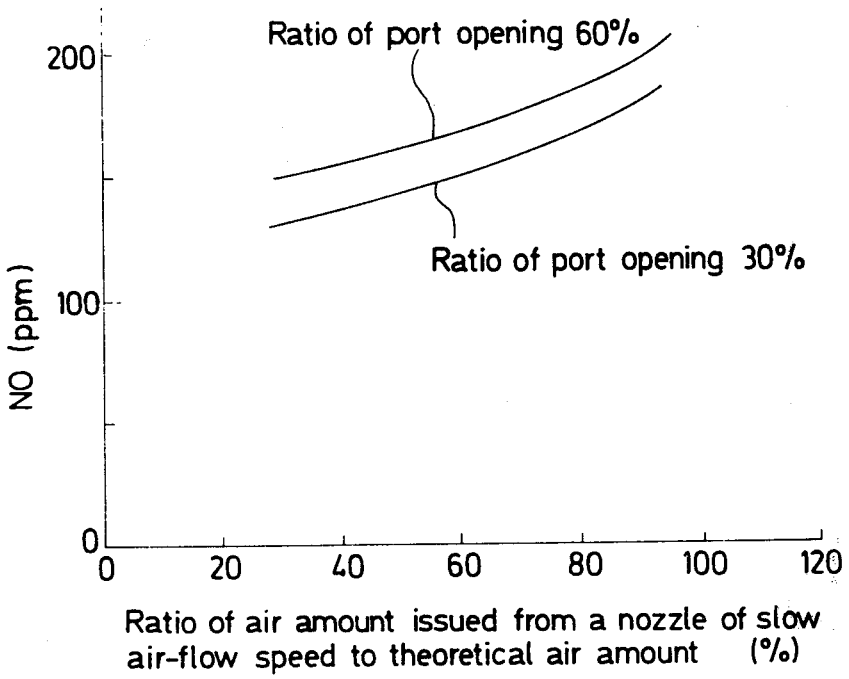

FIGS. 12 and 13 give brief summaries of the results, in the manner corresponding to FIGS. 9 and 10, respectively. The magnitude of combustion and other testing conditions used were the same as those of the preceding tests summarized in FIGS. 9 and 10. The only exception is that, as shown in FIG. 11*a*, the air nozzles and the fuel nozzle of the reference burner were disposed symmetrically with respect to the central axis of the burner, in contrast with the unsymmetrical arrangement of the invention as in FIG. 11*b*. A comparison of FIGS. 12, 13 with FIGS 9, 10 will clearly show that not only do the two burners differ in the burner characteristics but also, from the standpoint of NOx control to which the present invention is directed, the reference burner yields as much as 150 to 200 ppm NOx, or far beyond the range to meet the accepted present-day limit for pollution control.

It will be obvious from the above discussion of the test results that the constituent factors of the invention set forth in the appended claims are essential requisites to the control of NOx formation in burners.

As has been described hereinbefore, the present invention makes it possible for a burner of substantially the same size as conventional burners to achieve a NOx-controlling effect easily through combination of the stepwise combustion and inert gas addition methods. As demonstrated by the exemplary tests, the burner according to the invention reduces the NOx production to 80–100 ppm when grade C fuel oil is used as fuel, or to only about 40 ppm when the fuel is a gas, kerosene, or light oil. It thus attains a great anti-pollution effect with a lowcost construction. Moreover, the present burner may be varied in size and/or shape according to the magnitude of combustion ranging from 50 to 500 × $10^4$ Kcal/Hr to suit many different applications, particularly for use with common industrial heating furnaces.

What is claimed is:

1. A burner comprising, in combination, a case having a central axis, a side wall, an outer end wall and an inner end opening into a furnace; partition means dividing the space enclosed by said side wall into plural sub-spaces opening into the furnace and each constituting an air nozzle having at least one air inlet port respective thereto; air velocity regulator means operatively associated with said nozzles to control the respective velocities of the air issuing therefrom, relative to the mean air velocity through the total air flow opening area of said nozzles, so that at least one nozzle has an air velocity higher than said mean air velocity and at least one other nozzle has an air velocity lower than said mean air velocity, with the flow opening area for the lower velocity air flow being from 30% to 60% of said total air flow opening area; and fuel nozzle means operatively associated with the at least one other nozzle having an air velocity lower than said mean air velocity; said air velocity regulator means controlling the air supply so that the amount of air supplied at low velocity is not more than 70% of the theoretical air required for combustion of the fuel delivered to the furnace by said fuel nozzle means.

2. A burner according to claim 1 in which said case is circular-shaped in transverse section normal to the central axis thereof.

3. A burner according to claim 1 in which said case is square-shaped in transverse section normal to the central axis thereof.

4. A burner according to claim 1 wherein said air-velocity regulator means comprises inlet ports formed in the case side wall and register means formed with corresponding damper ports and disposed around said case side wall.

5. A method of firing a furnace with reduced formation of nitrogen oxide in the combustion exhaust gases, said method comprising the steps of providing a burner having a central axis and formed with plural air nozzles opening toward the furance and disposed unsymmetrically with respect to the central axis of the burner; controlling the velocity of combustion air issuing from at least one nozzle to be higher than the mean air velocity through the total air nozzle opening area into the furnace; controlling the velocity of combustion air issuing from at least one other nozzle to be lower than such mean air velocity through the total air nozzle opening area into the furnace; controlling the opening area for the flow of the lower velocity air to be from 30% to 60% of the total air nozzle opening area into the furnace; supplying fuel into the furnace in operative association with the lower velocity air flow; and controlling the amount of the lower velocity air flow to be not more than 70% of the theoretical air for combustion of the fuel supplied to the furnace.

* * * * *